US005216450A

United States Patent [19]

Koitabashi et al.

[11] Patent Number: 5,216,450

[45] Date of Patent: Jun. 1, 1993

[54] INK JET HEAD CARTRIDGE

[75] Inventors: Noribumi Koitabashi; Hiromitsu Hirabayashi; Hitoshi Sugimoto; Haruo Uchida, all of Yokohama, Japan

[73] Assignee: Canon Kabushiki Kaisha, Tokyo, Japan

[21] Appl. No.: 602,659

[22] Filed: Oct. 24, 1990

[30] Foreign Application Priority Data

Oct. 24, 1989 [JP] Japan ..... 1-274840

[51] Int. Cl.[5] ..... B41J 2/175; B41J 2/05

[52] U.S. Cl. ..... 346/140 R

[58] Field of Search ..... 346/140

[56] References Cited

U.S. PATENT DOCUMENTS

| | | | |
|---|---|---|---|
| 3,953,862 | 4/1976 | Amberntsson | 346/140 R |
| 4,095,237 | 6/1978 | Amberntsson et al. | 346/140 |
| 4,306,245 | 12/1981 | Kasugayama | 346/140 |
| 4,313,124 | 1/1982 | Hara . | |
| 4,345,262 | 8/1982 | Shirato et al. . | |
| 4,419,678 | 12/1983 | Kasugayama et al. | 346/140 R |
| 4,459,600 | 7/1984 | Sato et al. . | |
| 4,463,359 | 7/1984 | Ayata et al. . | |
| 4,558,333 | 12/1985 | Sugitani et al. . | |
| 4,589,000 | 5/1986 | Koto et al. | 346/140 R |
| 4,723,129 | 2/1988 | Endo et al. . | |
| 4,740,796 | 4/1988 | Endo et al. . | |
| 4,771,295 | 9/1988 | Baker et al. | 346/1.1 |
| 4,929,969 | 5/1990 | Morris | 346/140 |
| 4,931,811 | 6/1990 | Cowger | 346/140 R |

FOREIGN PATENT DOCUMENTS

| | | |
|---|---|---|
| 056847 | 5/1979 | Japan . |
| 123670 | 7/1984 | Japan . |
| 138461 | 8/1984 | Japan . |
| 071260 | 4/1985 | Japan . |

*Primary Examiner*—Joseph W. Hartary

*Attorney, Agent, or Firm*—Fitzpatrick, Cella, Harper & Scinto

[57] ABSTRACT

An ink jet head cartridge includes an ink jet head unit having an ink passage in which an energy generating element for generating energy used to discharge ink is disposed, and an ink tank adapted to store the ink to be fed to the ink passage and having a vent opening for permitting the interior of the ink tank to communicate with the atmosphere and being formed integrally with the ink jet head unit. In the ink jet cartridge an area where an ink absorber is disposed, and an air area at least a part of which is defined by a tubular member and which is filled with air, are formed in an internal space of the ink tank, and a porous member is disposed in an air passage extending from the air area to the vent opening. An ink tank can be incorporated into the above-mentioned ink jet head cartridge, and an ink jet recording apparatus utilizing the above-mentioned ink jet head cartridge can be provided.

8 Claims, 5 Drawing Sheets

INK JET HEAD CARTRIDGE

BACKGROUND OF THE INVENTION

1. Field of the Invention

The present invention relates to an ink jet head cartridge integrally incorporating an ink jet head and an ink tank, and an ink jet recording apparatus on which such cartridge is mounted, and an ink tank.

2. Related Background Art

In the past, in a liquid jet recording apparatus such as an ink jet recording apparatus, generally, the ink was replenished for exchanging an empty ink cartridge by a new cartridge containing a predetermined amount of ink. In this case, if the ink jet recording head itself is cheap, a so-called head/ink-tank integral cartridge wherein a head and an ink tank containing a predetermined amount of ink are integrally formed has been used. In such a recording apparatus, since the recording head can be renewed without fail whenever a predetermined amount of recording is finished (i.e., a predetermined amount of ink is used up) due to the integral design of the ink tank and the head, it is possible to always maintain the good recording quality. And, even if the recording quality is poor, since the ink jet recording head itself can easily be replaced, it is possible to shorten the down time of the recording apparatus. Further, in replenishing the ink, foreign matter can be prevented from entering the ink.

By the way, such an ink cartridge integrally incorporating the head includes the ink tank for storing the ink and for supplying the ink to a discharging portion. Such an ink tank must meet the following functional requirements at least:

(1) preventing the leakage of the ink;
(2) preventing the vaporization of the ink;
(3) storing a predetermined amount of ink and supplying the ink to the discharging portion stably; and
(4) not blocking the discharge of the ink from the discharging portion.

As ink tanks which can meet such functional requirements, an ink tank including an ink bag and an ink tank including an ink absorber therein for applying negative pressure to the ink at the discharging portion have been already known (refer to FIG. 3 of U.S. Pat. No. 4,095,237).

However, in the above ink tank including the ink bag, with respect to the above requirement (4), in order to avoid the blocking of the discharge of the ink from the discharging portion due to the liquid head pressure of the ink, the relative positional relationship between the recording head and the ink tank is constructurally limited, and, further, it is necessary to provide a case for enclosing the ink bag independently from the ink bag in view of the treatment of the ink tank, thus making the ink tank expensive. On the other hand, in the ink tank including the ink absorber which can avoid the blocking of the discharge of the ink from the discharging portion due to the liquid head pressure of the ink, it is practical to provide a vent opening connecting the interior of the ink tank with the atmosphere in order to cope with the change in pressure in the ink tank due to the reduction of the ink amount in the tank (by ink consumption) and/or due to a change in temperature of air in the tank. However, in this case, the ink is liable to be vaporized through the vent opening (this does not meet the above requirement(2)), and, if the ink tank is left in this condition for a long time, vaporization of the ink will occur.

For example, the aqueous ink which has widely been used because it is advantageous in view of safety, generally includes, as its main components, water, dye and a non-volatile solvent. If the volatile component such as water is vaporized, the ratio of the components included in the ink itself will largely change, thus deleterisusly the fixing ability of the ink or paper and/or the recording feature such as the ink density, and further clogging the discharging portion with ink due to the increase in the viscosity of the ink. Further, since the effective available amount of the ink in the ink tank itself is decreased, this structure is economically disadvantageous. In particular, the smaller the capacity of the ink tank or the cartridge of head/ink-tank integral type, the more serious are the disadvantages from the change in composition of the ink and/or the reduction of the ink amount due to the vaporization of the ink.

SUMMARY OF THE INVENTION

An object of the present invention is to provide an ink jet head cartridge wherein a head unit and an ink tank are integrally formed, and an ink tank itself, which can suppress the vaporization of the ink for a long time and maintain a stable recording feature, thus eliminating the above-mentioned conventional drawbacks.

Another object of the present invention is to provide an ink jet recording apparatus having such ink jet head cartridge.

In order to achieve the above object, an ink et head cartridge according to the present invention comprises an ink jet head unit having an ink passage in which an energy generating element for generating energy used to discharge ink is disposed, and an ink tank adapted to store the ink to be fed to the ink passage and having a vent opening for connecting the interior of the ink tank with the atmosphere and being formed integrally with the ink jet head unit, and is characterized in that an area where an ink absorber is disposed, and an air area at least a part of which is defined by a tubular member and which is filled with air are formed in an internal space of the ink tank, and a porous member is disposed in an air passage extending from the air area to the vent opening.

Further, an ink tank according to the present invention is adapted to store ink and has a vent opening for connecting the interior of the ink tank with the atmosphere, and is characterized in that an area where an ink absorber is disposed, and an air area at least a part of which is defined by a tubular member and which is filled with air are formed in an internal space of the ink tank, and a porous member is disposed in an air passage extending from the air area to the vent opening.

Furthermore, an ink jet apparatus according to the present invention includes an ink jet head cartridge comprising an ink jet head unit having an ink passage in which an energy generating element for generating energy used to discharge ink is disposed, and an ink tank adapted to store the ink to be fed to the ink passage and having a vent opening for connecting the interior of the ink tank with the atmosphere and being formed integrally with the ink jet head unit, and wherein an area where an ink absorber is disposed, and an air area at least a part of which is defined by a tubular member and which is filled with air are formed in an internal space of the ink tank, and a porous member is disposed in an air passage extending from the air area to the vent opening;

and a support member on which the ink jet head cartridge is rested.

According to the present invention, the vaporization of the ink is suppressed by the air passing resistance of the porous member having a large number of pores. Particularly, by providing the tubular air passage between the vent opening and the air area which is filled with the air, the fluid resistance of the air passage cooperates with the air passing resistance of the porous member to maintain the stable recording for a long time, in comparison with a conventional ink jet apparatus.

DESCRIPTION OF THE PREFERRED EMBODIMENTS

The present invention will now be explained in connection with embodiments thereof with reference to the accompanying drawings.

Figure 1A:
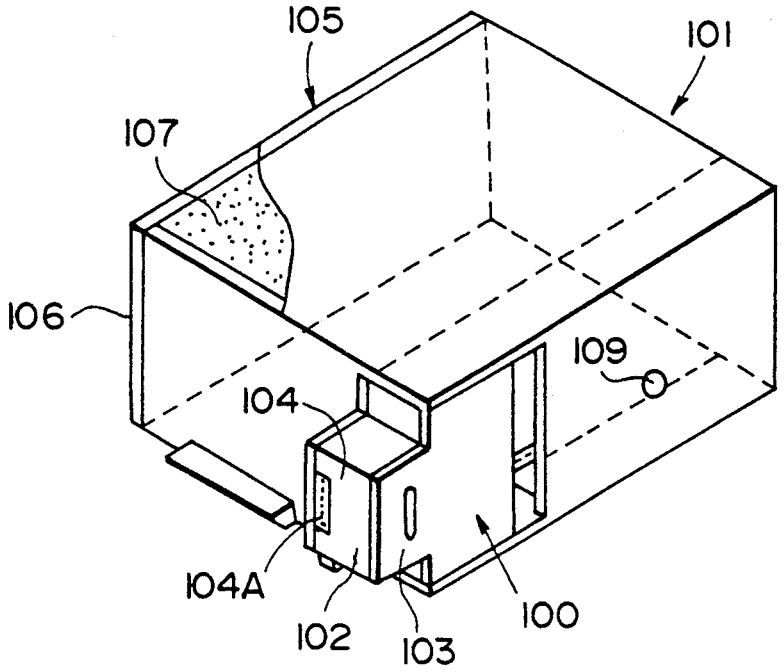
FIG. 1A is a schematic perspective view of an ink jet head cartridge according to a first embodiment of the present invention.
Figure 1B:
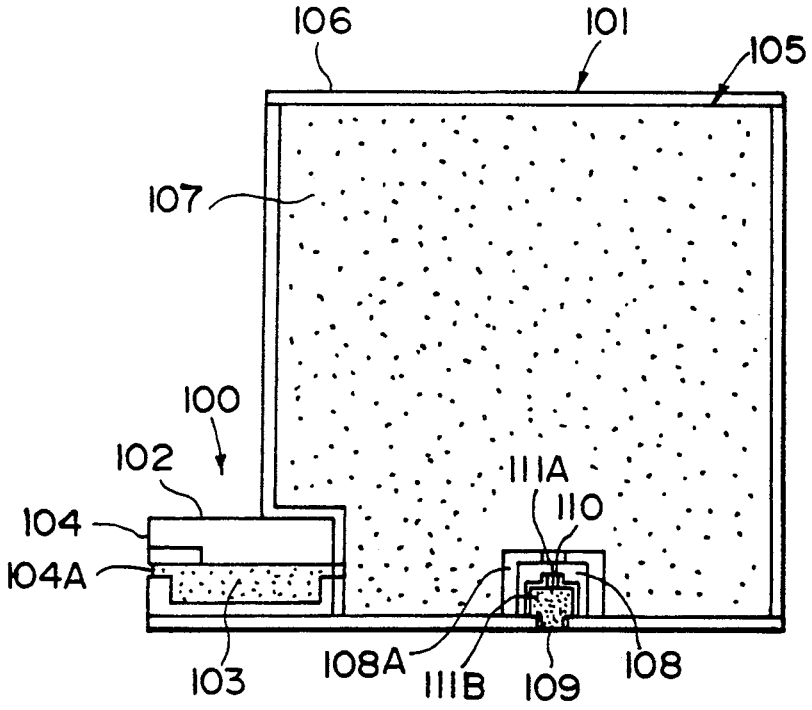
FIG. 1B is a sectional view of the ink jet head cartridge of FIG. 1A.

FIGS. 1A and 1B are a perspective view and a sectional view of a cartridge of the head/ink-tank integral type according to a first embodiment of the present invention, which can be mounted on a carriage of an ink jet recording apparatus according to the present invention. In these figures, the reference numeral 100 denotes a recording head unit of a cartridge 101; 102 denotes a discharging portion constituted by members relating to the ink discharging function of the recording head unit 100; and 103 denotes a supply tank portion for supplying ink to the discharging portion 102. The discharging portion 102 includes a plurality of discharge openings 104A disposed in a discharging surface 104, liquid passages for directing the ink to the discharge openings 104, discharge energy generating elements such as electrical/thermal converters disposed in the respective liquid passages, and a supply liquid chamber communicating with the liquid passages.

Further, the reference numeral 105 denotes an ink tank incorporated into the cartridge 101; 106 denotes a lid member for the ink tank; and 107 denotes an ink absorber contained in the ink tank 105 and made of porous material, fibers or the like and impregnated with the ink. In the ink tank 105, a hollow chamber (refer to as "buffer chamber" hereinafter) 108 is formed or defined by a cylindrical tubular member 108A along one edge of the ink absorber 107, and a vent opening 109 is formed so that the interior of the buffer chamber 108 communicates with the atmosphere. Further, a porous member 110 having a large number of fine pores is arranged to close the vent opening 109.

Incidentally, preferably, the porous member 110 is made of a sponge-like material having pores each having a diameter of about 10 μm, and it is desirable that the total effective opening area of about 100 μm is maintained in the porous member. Further, more preferably, the porous member is made of a water repelling material such as Teflon, whereby, even if the moisture is absorbed in the material, o the pores are not substantially closed.

Figure 2A:
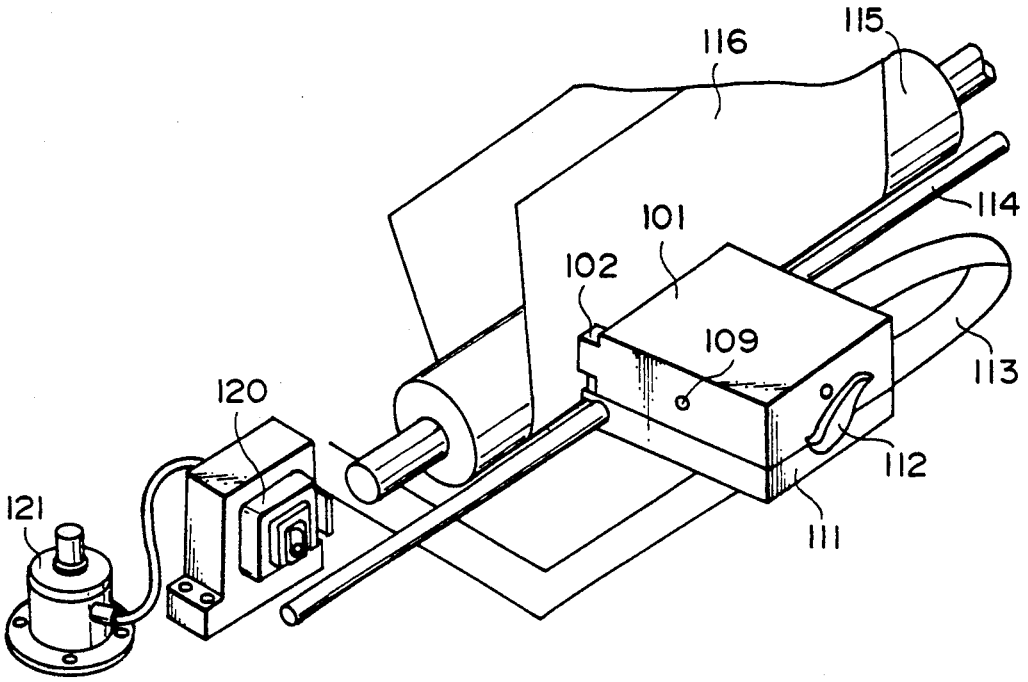
FIG. 2A is a perspective view of an ink jet apparatus on which the ink jet head cartridge according to the first embodiment of the present invention is mounted, showing an operating or recording condition.

FIG. 2A shows an example of an ink jet recording apparatus on which a recording head including the cartridge of head/ink-tank integral type or replaceable cartridge (refer to merely as "recording head" hereinafter) is mounted. In FIG. 2A, the reference numeral 111 denotes a carriage on which the recording head 101 is mounted; 112 denotes a holder member for fixing the recording head 101 onto the carriage in place; and 113 denotes a flexible cable connected to a connector (not shown) arranged on the carriage 111 and adapted to supply a discharge signal to the discharging portion on the basis of recording data. Incidentally, for example, the positioning of the recording head 101 with respect to the carriage 111 is carried out by engaging locking holes (not shown) formed in the recording head 101 by corresponding locking projections (not shown) formed on the Carriage 111.

The carriage 111 on which the recording head 101 is mounted in this way can be shifted along a guide shaft 114 by means of any driving means (not shown). During the shifting movement of the carriage, the recording is effected by discharging the ink from the discharge openings 104A of the discharging portion 102 of the recording head onto a recording medium (refer to as "recording sheet" hereinafter) held by a platen 115. Incidentally, the reference numeral 120 denotes a cap member which can be engaged by or be positioned closely to the discharging surface 104 when the discharging portion 102 of the recording head 101 reaches a left (FIG. 2A) home position, so that the ink is absorbed by a suction pump 121 for performing a head recovering operation.

Figure 2B:
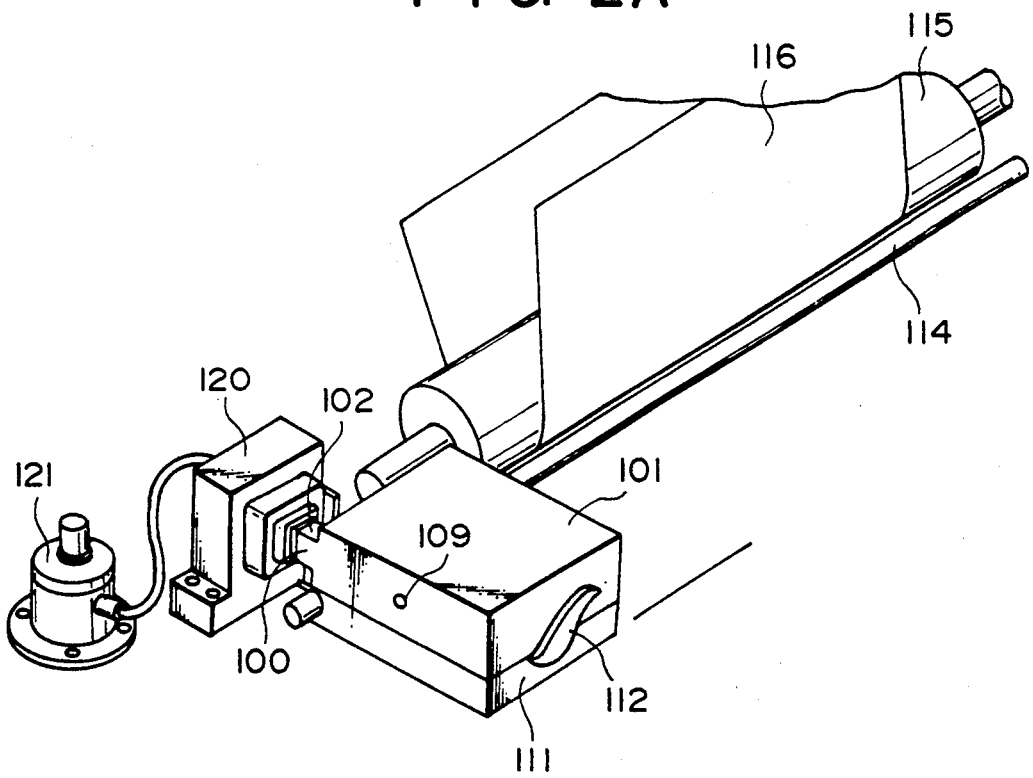
FIG. 2B is a perspective view similar to FIG. 2A, showing a capping condition.

FIG. 2B shows a condition that the cap member 120 is engaged by the discharging portion 102 of the recording head 101 to perform the head recovering operation.

Referring to FIGS. 1A and 1B again, in order to prevent the leakage of the ink from the discharge openings and/or vent opening due to the change in storing condition of the ink derived from the change in temperature of the surroundings, the porous member 110 has disposed between the buffer chamber 108 and the vent opening 109. Now, in the ink tank having such construction, if the surrounding temperature increases, the volume of the ink impregnated in the ink absorber will also increase or swell. In this Case, however, the swelled ink merely spreads out into the buffer chamber 108 and is stored in the buffer chamber 108 without leaking through the vent opening 109. And, as the surrounding temperature returns to the normal temperature value, the spreaded ink is again absorbed by the ink absorber 107.

Further, the vent opening 109 serves not only to introduce into the ink tank the air of an amount corresponding to the consumed amount of the ink discharged from the discharge openings 104A in the recording operation and the ink recovering operation, but also to prevent pressure fluctuation in the ink tank even if the amount of ink in the tank is increased or decreased due to the change in the ink storing condition. In this way, according to this first embodiment, by providing the porous member 110 around the vent opening 109, the opening area of the vent opening is substantially restricted. Further, it is possible to prevent the clogging of the vent opening due to the contact between the vent opening and the ink, and to suppress the vaporization of the ink in the ink tank 105 by increasing the air passing resistance.

Incidentally, in this embodiment, while the porous member 110 was contained in a chamber forming member 111B having an aperture 111A as shown, the chamber forming member 111B may not necessarily be provided so long as the porous member 110 can maintain its shape or configuration by itself.

Figure 3:
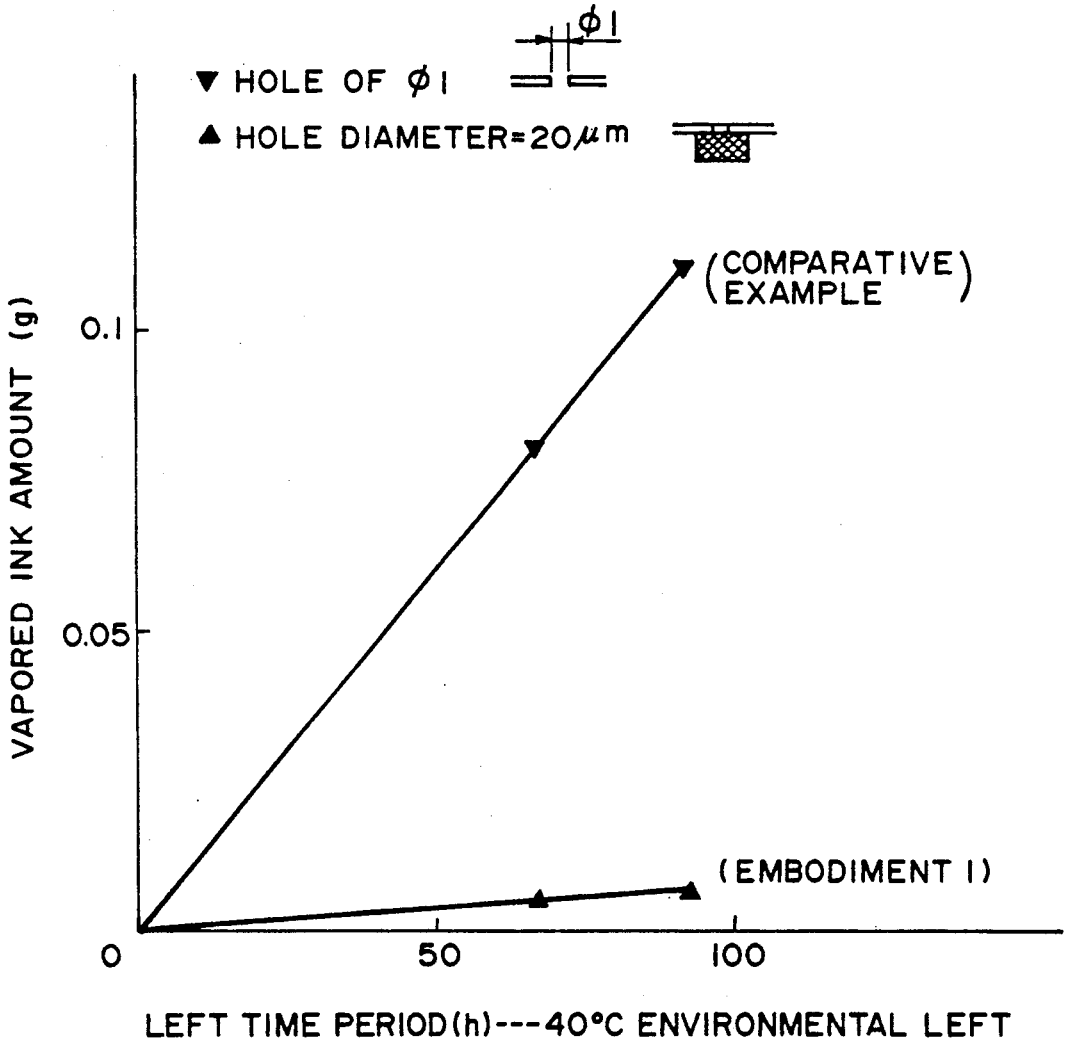
FIG. 3 is a graph showing an ink vaporizing feature of an ink tank.

FIG. 3 numerically shows the effect of preventing the vaporization of the ink through the vent opening or hole, obtained by the first embodiment of the present invention.

In FIG. 3, under the circumstances having the temperature of 40° C. and the humidity of 30%, which expedites the vaporization of the ink, when the discharging portion 102 is covered by the cap member 120 and the ink tank of the cartridge has a vent opening or hole of 1.0 ϕmm (comparative example) and when such vent opening is covered by the porous member 110 made of continuous foam urethane material providing an opening area of about 0.3 mm (embodiment 1), the respective vapored ink amounts are shown. The ink absorber 107 is made of urethane. Incidentally, the initial ink amount was set to 40 grams.

As apparent from FIG. 3, in the embodiment 1, the vapored ink amount could be reduced to 1/10 or less in comparison with that of the comparative example, thereby suppressing any deleterisus non-discharge of ink due to the vaporization of the ink at the most. Incidentally, the ink used in this embodiment has the following composition: i.e., diethylene glycol (DEG) of 15%, ethanol of 5%, black dye of 3% and water of 77%.

In this ink, the water and ethanol can be vaporized. However, when the water and ethanol are vaporized excessively as in the comparative example, the ratios of the DEG and the dye are increased, thus causing the poor fixing of the ink on the recording paper and/or having a deleterisus influence upon a recording feature such as the recording density, and further causing the clogging of the discharging portion 102 with the ink due to the increase in the viscosity of the ink. On the other hand, in this embodiment, of the present invention although there was a slight change in the composition of the ink due to a slight vaporization of the ink, no practical problems occurred, and high recording quality could be maintained. Further, the disadvantage of a high running cost due to the reduction of the effective available ink amount could be minimized.

Figure 4A:
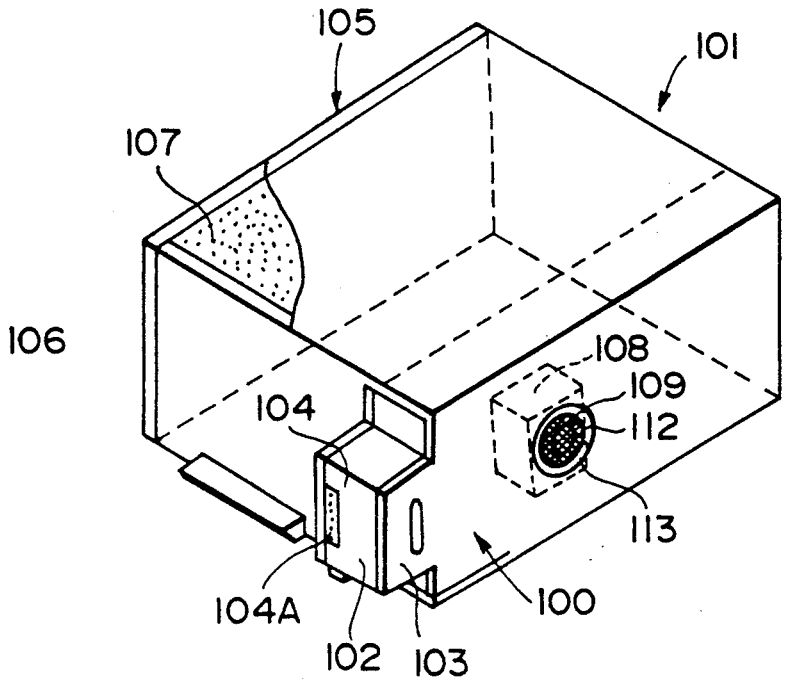
FIG. 4A is a schematic perspective view of an ink jet head cartridge according to a second embodiment of the present invention.
Figure 4B:
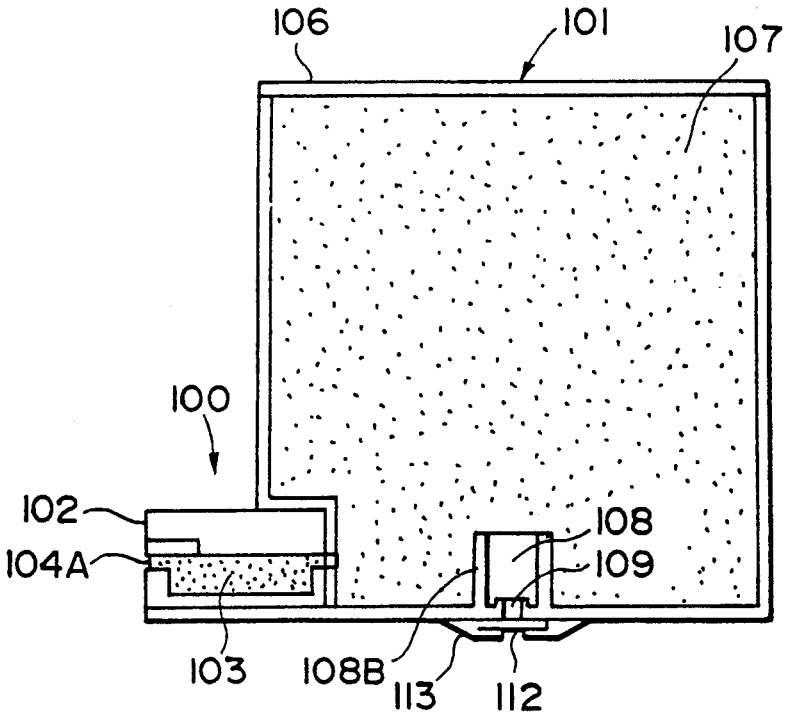
FIG. 4B is a sectional view of the ink jet head cartridge of FIG. 4A.

FIGS. 4A and 4B are schematic perspective view and a sectional view, respectively, of an ink jet head cartridge according to a second embodiment of the present invention. In this second embodiment, a filter-like porous member 112 having a plurality of pores is disposed on and outside of the vent opening 109. In this case, the vent opening 109 had a diameter of 1.0 mmϕ and the porous member 112 included about 200 pores each having a dimension of 20 μm×20 μm to provide a substantial opening area of about 300 μm×300 μm. Incidentally, the reference numeral 113 denotes a holder member for holding the porous member 112 around the vent opening 109.

Also in this second embodiment, it was ascertained that the same technical effect as in the previous first embodiment was obtained. Further, in this second embodiment, since the porous member is merely disposed on the outside of the ink tank of the cartridge having the vent opening, it is possible to effectively prevent the vaporization of the ink with a very simple and inexpensive construction. Furthermore, in this second embodiment, while the porous member 112 having a thickness of 0.2 mm was used, if the porous member having a thickness of 1.0 mm is used, it was ascertained that a better effect for preventing the vaporization of the ink was obtained.

In addition, the porous member 112 is not limited to one, member but a plurality of porous members may be used in the overlapped condition. In this case, the dimension of each pore in each porous member may be larger than that of the pore of the single porous member. Further, by providing a water repelling feature for the porous member 112 or by composing the porous member of a water repelling material, even if the ink fills the buffer chamber 108 defined by the rectangular tubular member 108B and tends to flow out of the vent opening 109, such over-flow can be prevented by the water repelling effect.

Now, with respect to the ink tank having the vent opening having a diameter of 1.0 mmϕ (comparative example) and the ink tank including the porous member 112 according to the second embodiment arranged outside of the vent opening, tests were carried out to check the vaporized ink amount and the recording feature by using the ink having the same composition as that in the first embodiment. Incidentally, in this case, the initial ink amount was set to 30 cc, and both ink tanks were left for a month and three months, respectively, under surroundings having a temperature of 30° C. and a humidity of 20%. The result of the tests is shown in the following Table 1.

TABLE 1

| | Test Result as to Left Cartridge | | | | | |
|---|---|---|---|---|---|---|
| | RD (OD) | FF (sec) | DUF (sec) | SF (h) | Printing Q. | NDGR |
| Before Left | 1.3 | 10 | 80 | 10 | Good | 1/1000 or less |
| EB. 1 month left | 1.3 | 10 | 80 | 10 | Good | 1/1000 or less |
| CE. 1 month left | 1.35 | 15 | 60 | 8 | C.S.B. (Feathering) | 1/500 |
| EB. 3 month left | 1.3 | 10 | 75 | 10 | Good | 1/1000 or less |
| CE. 3 month left | 1.5 | 20 | 30 | 5 | C.S.T.S.P. | 1/200 |

RD is the reflection density, FF is the fixing feature, DUF is a discharge uniform feature, SF is a solidifying feature, Printing Q. is the printing Quality, NDGR is the non-discharge generating ratio, EB is a embodiment, CE is comparative example, C.S.B. means that "character is slightly blurred", and C.S.T.S.P. means that "character becomes slightly thin in solid printing".

As apparent from the Table 1, according to the test result, in the embodiment of the present invention, there was substantially no vaporization of the ink and no change in the composition of the ink. Thus, naturally, in comparison with the condition before the ink tank is left as it is, the condition of the ink tank according to the embodiment of the present invention Was substantially not changed and gave a good result.

Remarks 1

The "reflection density " relates to a value of the ink density measured by a Mackbeth reflection densitometer after solid printing is effected in an area of 1 $cm^2$.

Remarks 2:

The "fixing feature" was determined by the presence/absence of the trace of the ink transferred onto the Silbon paper as a transfer sheet by rubbing the solid printing area of 1 $cm^2$ with the transfer sheet with a predetermined pressure, the solid printing area being formed on a kind of paper (plain paper) and being left for a predetermined time period.

Remarks 3:

The "discharge uniform feature" refers to a time period (seconds) between the initiation of the ink discharge from each discharge opening 104A to the next normal discharge o the ink.

Remarks 4:

The "solidifying feature" refers to a time period (hrs.) until the ink is solidified after a capillary tube containing the ink picked-up from the cartridge under the condition having a temperature of 15° C. and a humidity of 10% was disposed in an oven having a temperature of 60° C. and a humidity of 5%.

Remarks 5:

The "printing quality" is obtained by evaluating the images including various patterns printed on paper.

Remarks 6:

The "non-discharge generating ratio" means that, when the above-mentioned patterns are continuously printed on a plurality of papers, the number of papers normally printed until any non-discharge portion appears in the image pattern (for example, "1/1000 or less" means that the non-discharge portion did not appear in the image pattern until 1000 or more sheets were normally printed).

Figure 5A:
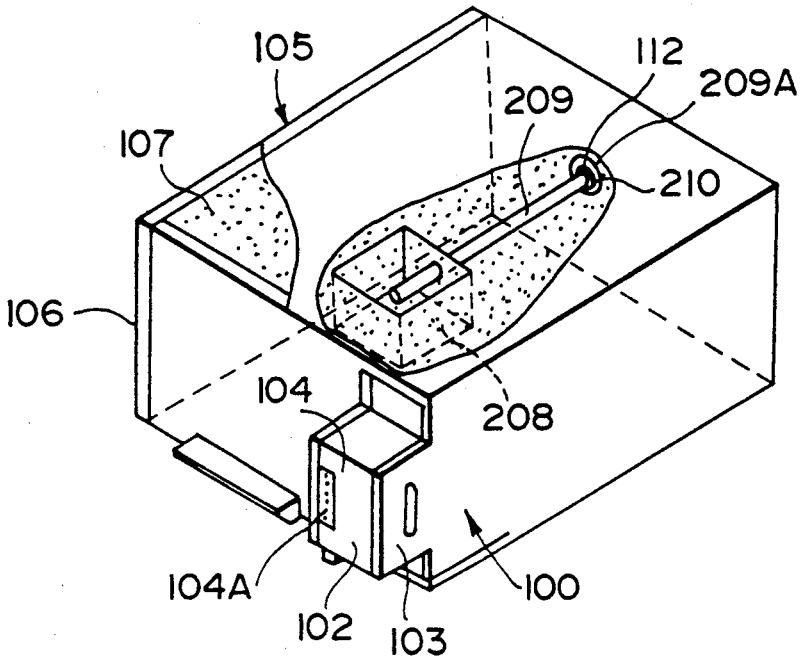
FIG. 5A is a schematic perspective view of an ink jet head cartridge according to a third embodiment of the present invention.
Figure 5B:
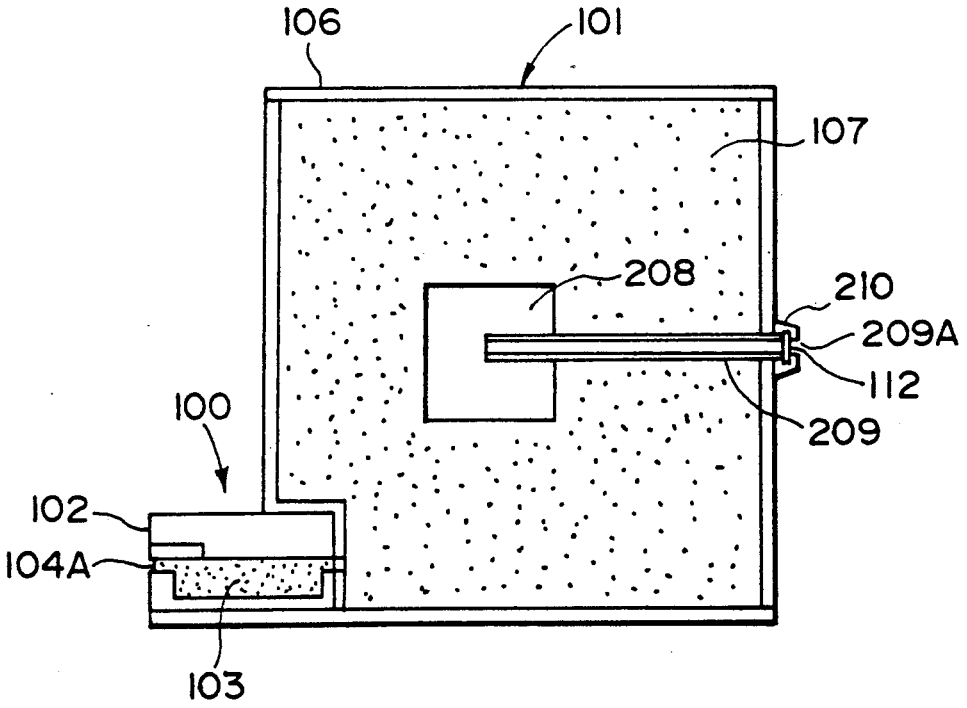
FIG. 5B is a sectional view of the ink jet head cartridge of FIG. 5A.

FIGS. 5A and 5B are a schematic perspective view and a sectional view of an ink jet head cartridge according to a third embodiment of the present invention.

In this third embodiment, a hollow buffer chamber 208 is formed near the central portion of the ink absorber 107, and a vent passage tube 209 is arranged to extend from substantially the central portion of the buffer chamber 208 to the atmosphere through the wall of the ink tank, and further, the porous member 112 is mounted on a vent opening 209A of the vent passage tube open to the atmosphere. Incidentally, the reference numeral 210 denotes a holder member for fixing the porous member 112 on the tank wall around the vent opening.

In an ink tank having such construction, since one end of the vent passage tube 209 protrudes into the buffer chamber 208 toward the center thereof, the risk that the ink enters into the vent passage tube can be avoided. Further, since the porous member 112 is arranged to cover the vent opening 209A of the other end of the vent passage tube 209, it is not necessary to especially reduce an inner diameter of the vent passage tube 209.

Furthermore, according to this third embodiment, by the multiplified effect of the air passing resistance of the vent passage tube 209 itself and of the air passing resistance of the porous member 112 arranged on the vent opening 209A, an excellent vaporization preventing effect regarding the ink in the ink tank can be attained, and further, by providing the porous member 112, dust or the like can be prevented from entering into the vent passage tube, thus avoiding the jamming of the tube.

Incidentally, in this third embodiment, while the buffer chamber 208 was formed in the central portion of the ink absorber 107, the buffer chamber may be positioned in the ink absorber at any position so long as the buffer chamber has a volume sufficient to contain or store the swelled ink amount and a vent passage tube having an adequate length can be established.

In addition, it is preferable to add the water repelling feature to the porous member 112, as in the previous embodiments. Further, in place of the provision of the porous member 112, a porous member as described in the first embodiment may be disposed in the vent passage tube 209; or, not only such porous member may be disposed in the vent passage tube but also the porous member 112 may be mounted on the vent opening 209A.

The present invention brings about excellent effects particularly in a recording head, recording device of the bubble jet system among the ink jet recording system.

As to its representative constitution and principle, for example, one practiced by use of the basic principle disclosed in, for example, U.S. Pat. Nos. 4,723,129 and 4,740,796 is preferred. This system is applicable to either of the so called ondemand type and the continuous type. Particularly, the case of the on-demand type is effective because, by applying at least one driving signal which gives rapid temperature elevation exceeding nucleus boiling corresponding to the recording information On an electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the abovementioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. No. 4,558,333, 4,459,60 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat converters as the discharging portion of the electricity-heat converter or Japanese Patent LaidOpen Application No. 59-138461 which discloses the constitution having the opening for absorbing pressure wave of heat energy correspondent to the discharging portion.

Further, as a recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case of a recording head of the cartridge type being providing integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording to perform in a preliminary mode in which discharging is performed separate from recording.

Further, as the recording mode of the recording device, the present invention is extremely effective for not only the recording mode only of a primary stream color such as black etc., but also a device equipped with at least one of plural different colors or full color by color mixing, whether the recording head may be either integrally constituted or combined in plural number.

In the above-mentioned embodiments, while the example of liquid was discussed, ink having a solid condition at room temperature or ink becoming a melted at room temperature can be used in the present invention. In the above-mentioned ink jet recording apparatus, since it is practical that the temperature of the ink is controlled to maintain the viscosity of the ink in a stable ink discharging range by adjusting the temperature of the ink within a range between 30° C. and 70° C., the ink may be in liquid form when the recording start signal is applied to the apparatus. In addition, by preventing the vaporization of the ink by using the positive thermal energy to heat the ink from the solid form to the liquid form, or by utilizing ink solidifying in when the apparatus is left for a substantial period of time to prevent the vaporization of the ink, any ink liquidized by the application of the thermal energy, such as ink being discharged in a liquid form (obtained by the application of the thermal energy in response to the recording start signal) or ink starting to solidify when it arrives on the recording paper can be used in the present invention. In such cases, the ink may be held in the recesses or through pores in a porous sheet and be positioned in confronting relation to electrical/thermal converters, as disclosed in the Japanese Patent Laid-Open Nos. 54-56847 and 60-71260. In the present invention, the most effective method regarding the abovementioned each ink is a method carrying out film boiling.

In the present invention, a stable ink supply feature regarding the ink in the ink tank can be established by disposing the ink absorber in the entire space in the ink tank, and the pressure fluctuation in the ink tank derived from the change in the surrounding conditions and/or vibration of a apparatus can be suppressed by providing the hollow Chamber defined by a tubular member which permits the ink absorber to communicate with the vent opening. Further, by disposing the porous member between the hollow chamber and the vent opening, the vaporization of the ink from the ink tank is minimized.

More specifically, in the present invention, the amount of air in the tank can correspond to the ink amount consumed by being discharged from the discharge openings by sucking the air from the atmosphere to the ink tank through the vent opening. The change in the surrounding temperature and/or vibration are absorbed by the buffering action of the ink absorber and the buffer chamber. Even if the ink leaks from the ink absorber into the hollow chamber due to a change in the surrounding temperature and/or vibration of the apparatus, such ink is held in the ink tank by the porous member, and is returned to the ink absorber little by little. The vaporization of the ink through the vent opening is suppressed by the porous member. Further, since the ink vaporized from the ink absorber at first saturates or fills the hollow chamber and then is liquidized in the porous member, the vaporized ink cannot substantially leak through the vent opening to the outside.

In this way, according to the present invention, in a path from the interior of the ink tank to the vent opening, the ink absorber, the hollow chamber and the porous member are effectively assembled or combined.

Incidentally, U.S. Pat. No. 4,771,295 discloses, in the drawings therein, an area where foam (denoted by the reference numeral "46") is disposed, an area where the air is filled, and a porous diaphragm (denoted by 82). However, in this U.S. Pat. No. 4,771,295 does not teach the the technical idea of the present invention at all. Further, in the above U.S. Pat. No. 4,771,295, the foam and the porous diaphragm will contact each other if the foam is displaced due to the vibration and the like, with the result that the area where the air is filled may disappear between the foam and the porous diaphragm.

To the contrary, in the present invention, since there is provided the tubular member for forming or defining at least a part of a hollow chamber, the above-mentioned excellent technical idea of the present invention can be realized without fail. Thus, the present invention has a remarkably high technical level.

Particularly, in the present invention, the third embodiment of FIGS. 5A and 5B, wherein the hollow chamber is positioned substantially at the central portion of the internal space if the ink tank, is extremely preferable, because, although the ink content absorbed in the ink absorber differs from position to position in the ink absorber due to the influence of the gravity, according to the third embodiment of the present invention, wherein the hollow chamber is positioned substantially at the central portion of the internal space of the ink tank (i.e., at the central portion of the ink absorber), whichever direction the discharge openings of the ink jet head cartridge are oriented or driven, the positional relationship between the ink absorber and the hollow chamber is maintained substantially in the same condition. That is to say, since the positional and constructural problem that the ink is more difficult to or more liable to migrate from the ink absorber to the hollow chamber in accordance with the orientation of the ink jet head cartridge can be completely solved, the balance between these three elements is further improved.

Further, in this embodiment, since the distance between the hollow chamber and the vent opening inevitably becomes longer, the vaporization of the ink from the ink absorber through the vent opening becomes more difficult, and the vaporized ink is liable to be liquified and to be returned to the ink absorber. Further, according to this embodiment, the following advantage can also be obtained.

Generally, since the ink absorber is urged into the ink tank, the cavity (or space) content in the ink absorber at its central portion is larger than that at the peripheral portion thereof. Thus, as the ink is consumed, the ink in the ink absorber tends to concentrate toward the central portion of the ink absorber. However, in case of the embodiment shown in FIGS. 5A and 5B, since the hollow chamber is positioned in the central portion of the ink absorber, the above-mentioned concentration or offset of the ink is improved, thus always keeping the uniform distribution of ink in the ink absorber. In this way, it is possible to use up the ink in the ink absorber completely.

As mentioned above, according to the present invention, since the porous member having a large number of pores is disposed in or on the vent passage tube formed with respect to the internal space of the ink tank and the vent opening, it is possible to suppress the vaporization of the ink, thereby maintaining excellent recording features of the apparatus and reducing the running cost of the apparatus.

Further, by providing the air filling area in the vicinity of the ink absorber contained in the internal space of the ink tank and by providing the vent passage extending between the air filling area and the vent opening and by disposing the porous member in the vent passage, the vaporization of the ink can be further suppressed by the multiplified effect of the vent passage and of the porous member.

What is claimed is:

1. An ink jet head cartridge comprising:

an ink jet head unit having an ink passage in which an energy generating element for generating energy used to discharge ink is disposed;

an ink tank adapted to store the ink to be fed to said ink passage and having a vent opening for connecting the interior of said ink tank with the atmosphere and being formed integrally with said ink jet head unit, wherein the interior of said ink tank includes an ink absorber area where an ink absorber is disposed, an air area filled with air, and an air passage extending from said air area to said vent opening; and a porous member disposed in the air passage extending from said air area to said vent opening;

wherein said air area is disposed substantially at a central portion of the interior of said ink tank.

2. An ink jet head cartridge according to claim 1, wherein said air passage comprises a tube extending between said air area and vent opening.

3. An ink tank adapted to store ink and having a vent opening therein for connecting an interior of said ink tank with the atmosphere, wherein the interior of said ink tank includes an ink absorber area where an ink absorber is disposed, an air area filled with air, and an air passage extending from said air area to said vent opening, and wherein said ink tank further comprises:

a porous member disposed in the air passage extending from said air area to said vent opening, wherein said air area is disposed substantially at a central portion of the interior of said ink tank.

4. An ink tank according to claim 3, further comprising an ink jet head unit having an energy generating element for generating energy used to discharge ink, wherein said energy generating element comprises an electrical/thermal converter for generating thermal energy as said energy.

5. An ink jet recording apparatus including:

an ink jet head cartridge comprising:

an ink jet head unit having an ink passage in which an energy generating element for generating energy used to discharge ink is disposed, an ink tank adapted to store the ink to be fed to the ink passage and having a vent opening for connecting the interior of the ink tank with the atmosphere and being formed integrally with said ink jet head unit, wherein the interior of said ink tank includes and ink absorber area where an ink absorber is disposed, an air area filled with air, and an air passage extending from said air area to said vent opening, and a porous member disposed in the air passage extending from said air area to said vent opening; and a support member on which said ink jet head cartridge is supported, wherein said air area is disposed substantially at a central portion of the interior of said ink tank.

6. An ink jet recording apparatus according to claim 5, wherein said energy generating element comprises an electrical/thermal converter for generating thermal energy as said energy.

7. An ink jet recording apparatus according to claim 5, wherein said support member comprises a carriage on which said ink jet head cartridge is mounted and which can be reciprocably shifted.

8. An ink recording apparatus according to claim 5, wherein said air passage comprises a tube extending between said air area and said vent opening.

* * * * *

UNITED STATES PATENT AND TRADEMARK OFFICE

CERTIFICATE OF CORRECTION

PATENT NO. : 5,216,450

DATED : June 1, 1993

INVENTOR(S) : NORIBUMI KOITABASHI, ET AL.

It is certified that error appears in the above-identified patent and that said Letters Patent is hereby corrected as shown below:

COLUMN 1

Line 13, "for" should read --by-- and "by" should read --with--.

COLUMN 2

Line 9, "deleterisusly" should read --deleteriously affecting-- and "or" should read --on--.
Line 31, "et" should read --jet--.

COLUMN 3

Line 10, "the" should be deleted.
Line 63, "(refer" should read --(referred--.

COLUMN 4

Line 10, "o" should be deleted.
Line 15, "(refer" should read --(referred--.
Line 28, "Carriage" should read --carriage--.
Line 35, "(refer" should read --(referred--.
Line 51, "has" should read --was--.
Line 56, "Case," should read --case,--.

COLUMN 5

Line 36, "deleterisus" should read --deleterious--.
Line 47, "deleterisus" should read --deleterious--.
Line 51, "embodiment," should read --embodiment-- and "invention" should read --invention,--.
Line 58, "are" should read --are a--.

UNITED STATES PATENT AND TRADEMARK OFFICE

CERTIFICATE OF CORRECTION

PATENT NO. : 5,216,450

DATED : June 1, 1993

INVENTOR(S) : NORIBUMI KOITABASHI, ET AL.

It is certified that error appears in the above-identified patent and that said Letters Patent is hereby corrected as shown below:

COLUMN 6

Line 17, "one, member" should read --one member,--.
Line 58, "Quality," should read --quality--.
Line 59, "a" should be deleted.

COLUMN 7

Line 1, "Was" should read --was--.
Line 20, "o" should read --of--.

COLUMN 8

Line 22, "system." should read --systems.--.
Line 27, "ondemand" should read --on-demand--.
Line 32, "On an" should read --on--.
Line 58, "4,459,60" should read --4,459,600--.
Line 67, "LaidOpen" should read --Laid-Open--.

COLUMN 9

Line 53, "in" should be deleted.
Line 55, "liquidized" should read --liquified--.
Line 68, "each ink" should read --inks--.

COLUMN 10

Line 6, "a" should read --the--.
Line 7, "the" should read --a-- and
"Chamber" should read --chamber--.
Line 40, "in" should be deleted.
Line 41, "the the" should read --the--.

UNITED STATES PATENT AND TRADEMARK OFFICE

CERTIFICATE OF CORRECTION

PATENT NO. : 5,216,450

DATED : June 1, 1993

INVENTOR(S) : NORIBUMI KOITABASHI, ET AL.

It is certified that error appears in the above-identified patent and that said Letters Patent is hereby corrected as shown below:

COLUMN 10

Line 56, "if" should read --of--.
Line 59, "the" (last occurrence) should be deleted.

COLUMN 11

Line 1, "more difficult to or" should be deleted.

COLUMN 12

Line 7, "vent" should read --said vent--.
Line 54, "ink" should read --ink jet--.

Signed and Sealed this

Twenty-sixth Day of April, 1994

Bruce Lehman

*Attest:*

BRUCE LEHMAN

*Attesting Officer*

*Commissioner of Patents and Trademarks*